US009980029B2

(12) United States Patent
Vos et al.

(10) Patent No.: US 9,980,029 B2
(45) Date of Patent: May 22, 2018

(54) RECEIVER-IN-CANAL ASSEMBLY COMPRISING A DIAPHRAGM AND A CABLE CONNECTION

(71) Applicant: Sonion Nederland B.V., Hoofddorp (NL)

(72) Inventors: Ewian Vos, Amsterdam (NL); Konrad van den Berg, Zoetermeer (NL); Mattijs Tjepkema, Velsen-Noord (NL); Gerardus Johannes Franciscus Theodorus van der Beek, Amsterdam (NL); Arno Willem Koenderink, Oostzaan (NL); Dennis Jacobus Mattheus Mocking, Utrecht (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days. days.

(21) Appl. No.: 15/078,136

(22) Filed: Mar. 23, 2016

(65) Prior Publication Data

US 2016/0286298 A1 Sep. 29, 2016

(30) Foreign Application Priority Data

Mar. 25, 2015 (EP) ..... 15160779

(51) Int. Cl.
*H04R 1/10* (2006.01)
*H04R 25/00* (2006.01)

(52) U.S. Cl.
CPC ..... *H04R 1/1016* (2013.01); *H04R 1/1033* (2013.01); *H04R 1/1075* (2013.01);
(Continued)

(58) Field of Classification Search
CPC ..... H04R 11/02; H04R 9/025; H04R 9/027; H04R 9/00
(Continued)

(56) References Cited

U.S. PATENT DOCUMENTS 3,515,818 A * 6/1970 Tibbetts ..... H04R 11/00 381/189
5,193,116 A * 3/1993 Mostardo ..... H04R 11/02 381/324

(Continued)

FOREIGN PATENT DOCUMENTS

WO WO 2007/140403 12/2007
WO WO 2010/132359 11/2010

OTHER PUBLICATIONS

European Search Report for Application No. EP 15160779, date of completion of the search Sep. 30, 2015 (2 pages).

*Primary Examiner* — Suhan Ni
(74) *Attorney, Agent, or Firm* — Nixon Peabody LLP

(57) ABSTRACT

A receiver-in-canal (RIC) assembly for positioning in or at an ear canal of a user. The RIC assembly includes a housing having an opening between an exterior space outside the housing and an internal space inside the housing, and a cable connection located in the housing and facilitating connection of a cable to the RIC assembly. Furthermore, the RIC assembly includes a first diaphragm extending in a first plane in the housing, and a first motor electrically connected to the cable connection and operatively connected to the first diaphragm. The cable connection is located relative to the first diaphragm such that at least a part of it can be projected onto a movable part of the first diaphragm in a direction perpendicular to the first plane and where the cable connection means is located in continuation of the first motor in a plane parallel to the first plane.

20 Claims, 7 Drawing Sheets

(52) U.S. Cl.
CPC ..... *H04R 25/608* (2013.01); *H04R 25/602* (2013.01); *H04R 2460/11* (2013.01)

(58) Field of Classification Search
USPC ..... 381/322, 182, 353, 396, 417–418
See application file for complete search history.

(56) References Cited

U.S. PATENT DOCUMENTS 5,222,050 A * 6/1993 Marren ..... H04R 1/44 181/132
5,960,093 A * 9/1999 Miller ..... H04R 11/02 381/324
6,788,796 B1 9/2004 Miles et al.
6,831,577 B1 12/2004 Furst
6,853,290 B2 2/2005 Jorgensen et al.
6,853,735 B2 * 2/2005 Imahori ..... H04M 1/035 381/386
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,931,140 B2 * 8/2005 Van Halteren ..... H04R 9/063 181/173
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doom et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 * 3/2007 van Halteren ..... H04R 11/02 381/398
7,206,428 B2 4/2007 Geschiere et al.
7,221,767 B2 5/2007 Mullenborn et al.
7,221,769 B1 5/2007 Jorgensen
7,227,968 B2 6/2007 van Halteren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 * 4/2010 Wilmink ..... H04R 7/18 381/324
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
2006/0083400 A1 * 4/2006 Miller ..... H04R 11/00 381/396
2009/0220113 A1 9/2009 Tiscareno
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.

* cited by examiner

RECEIVER-IN-CANAL ASSEMBLY COMPRISING A DIAPHRAGM AND A CABLE CONNECTION

CONNECTIONCROSS-REFERENCE TO RELATED APPLICATION

This application claims the benefit of European Patent Application Serial No. 15160779.3, filed Mar. 25, 2015, and titled "A Receiver-In-Canal Assembly Comprising A Diaphragm And A Cable Connection," which is incorporated herein by reference in its entirety.

FIELD OF THE INVENTION

The present invention relates to a receiver-in-canal assembly for positioning in or at an ear canal of a user. The receiver-in-canal assembly comprises a housing, a cable connection means facilitating connection of a cable to the receiver-in-canal assembly, a diaphragm, and a motor electrically connected to the cable connection means and operatively connected to the first diaphragm.

BACKGROUND OF THE INVENTION

Traditionally, a receiver-in-canal assembly for positioning in or at an ear canal of a user comprises an elongated slim housing to facilitate positioning of the receiver-in-canal assembly.

SUMMARY OF INVENTION

It is an object of embodiments of the invention to provide an improved receiver-in-canal assembly.

It is a further object of embodiments of the invention to provide a receiver-in-canal assembly which is shorter than traditional receiver-in-canal assemblies.

It is an even further object of embodiments of the invention to provide a receiver-in-canal assembly with improved output.

According to a first aspect, the invention provides a receiver-in-canal assembly for positioning in or at an ear canal of a user, the receiver-in-canal assembly comprising;

- a housing comprising an opening between an exterior space outside the housing and an internal space inside the housing;
- a cable connection means located in the housing and facilitating connection of a cable to the receiver-in-canal assembly;
- a first diaphragm extending in a first plane in the housing, and
- a first motor electrically connected to the cable connection means and operatively connected to the first diaphragm, wherein the cable connection means is located relative to the first diaphragm such that at least a part of it can be projected onto a movable part on the first diaphragm in a direction perpendicular to the first plane and located in continuation of the first motor in a plane parallel to the first plane.

The receiver-in-canal assembly may be adapted to receive an electrical signal via the cable and the cable connection means. Alternatively, this may be achieved by other ways of signal transfer, e.g. via optical means.

The motor being electrically connected to the cable connection means may be adapted to transform electrical energy into mechanical energy by movement of an armature forming part of the motor whereby sound waves may be created by movement of the diaphragm due to the operative connection of the motor with the diaphragm, whereby the receiver-in-canal assembly can output a corresponding audio signal.

In one embodiment, the first motor is operationally connected to the diaphragm by means of a diaphragm connecting member, such as a drive pin. Alternatively, the diaphragm may itself be attached to the first motor.

The diaphragm may comprise a plastic material, such as a polymer, or alternatively a metal material such as aluminium, nickel, stainless steel, or any other similar material. The diaphragm may divide the housing into two chambers, a front volume which is typically above the diaphragm and being connected to a sound output, and a back volume which is typically below the diaphragm and comprising the motor. The diaphragm comprises a movable part and may additionally comprise a static part. The static part may provide attachment of the diaphragm to the housing.

The housing may comprise an elongated sound channel provided in a spout member terminating in a sound output through which the receiver-in-canal assembly can output sound. In one embodiment, the sound channel is arranged at an opposite end of the housing relative to the opening through which the cable may extend.

The cable may at the other end be connected to a behind-the-ear part which may comprise electronics, controls, battery, microphone(s), and an additional receiver. As an example, the additional receiver may be a bass receiver.

The cable may be configured for transfer of at least an electrical or optical signal. In some embodiments the cable may further be configured for transfer of sound, e.g. from an additional receiver.

In the context of the present invention, the term "cable connection means" should be understood as the position in the housing at which the cable is attached to the receiver-in-canal assembly. The cable may be fixedly or detachably attached at the cable connection means. Thus, the cable connection means may comprise a socket, post, crimp-on or other type of interface in which a cable extending through the opening may be inserted. The cable connection means is located in the housing and facilitates connection of a cable to the receiver-in-canal assembly. The "cable connection means" may alternatively be denoted the "cable connection".

In one embodiment, the cable end terminates in a blunt which may be received in the housing. The blunt may further prevent the cable from being pulled out of the housing, and may form the cable connection means. The cable connection means may however also be of a size which prevents the cable from being pulled out of the housing.

It should be understood, that while a part of the cable connection means is located in the housing, another part of the cable connection means may be located outside the housing, whereby the cable connection means may lock the cable to the housing, as the part located inside the housing may ensure that the cable cannot be pulled out of the housing and the part located outside the housing may ensure that the cable cannot be pushed into the housing.

To provide a shorter receiver-in-canal assembly and/or a receiver-in-canal assembly capable of providing more output compared to a receiver-in-canal assembly of the same length, the cable connection means may be located at least partly under a movable part of the first diaphragm so that the movable part of the first diaphragm and the cable connection means overlap in a direction perpendicular to the first diaphragm. I.e. the cable connection means is located relative to the first diaphragm such that at least a part of it can be projected onto a movable part of the first diaphragm in a direction perpendicular to the first plane.

By further providing the cable connection means so that it is located in continuation of the first motor in a plane parallel to the first plane, a more compart receiver-in-canal assembly may be provided, which may further optimised the size of the receiver-in-canal assembly. It should be understood, that the plane parallel to the first plane need not be located centrally through the cable connection means and the first motor. Thus, in one embodiment the cable connection means may be located closer to the diaphragm than the motor, or alternatively further away from the diaphragm in a direction perpendicular to the diaphragm.

Furthermore, it should be understood that "in continuation of" covers embodiments were the cable connection means is arranged in contact with the first motor and embodiments were the cable connection means is arranged at a distance to the first motor.

The first motor and the diaphragm may in one embodiment be located in an internal shell in the housing. The shell may form a protrusion thereby creating a compartment under the protrusion in the housing. The cable connection means may be located relative to the protrusion such that at least a part of it can be projected onto protrusion in a direction perpendicular to the first plane. Thus, the cable connection means may be located in the compartment which may be located in the housing outside the internal shell and below the protrusion. In the compartment, different interface means, such as connectors, PCBs, etc. may be accommodated.

At least a part of the first diaphragm, such as an end portion of the first diaphragm may extend into the protrusion.

To further facilitate a shorter receiver-in-canal assembly, the first motor may by located relative to the first diaphragm such that at least a part of it can be projected onto the first diaphragm in a direction perpendicular to the first plane. Thus, the first motor may also be located at least partly under the first diaphragm so that the first diaphragm and the first motor overlap in a direction perpendicular to the first diaphragm.

To keep the receiver housing slim, it may be an advantage if the cable connection means is located behind the first motor in a direction parallel to the first plane. Thus, the first motor and the cable connection means may be arranged to that the projection of the cable connection means onto the first diaphragm does not overlap the projection of the first motor onto the first diaphragm. If the first motor and the cable connection means are arranged above each other or in different planes being parallel to the first direction a more compact housing may be achieved.

To optimise the size of the receiver-in-canal assembly, e.g. to provide more output compared to a receiver-in-canal assembly of the same size, the housing may comprise an inner surface 24*a,b* forming at least one indentation 19 defining a ledge on which the first diaphragm is supported. The inner surface 24*a,b* may be formed by wall sections forming the housing. Thus, the at least one indentation 19 may be formed in one or more of such wall sections. To support the first diaphragm, the wall sections may be substantially perpendicular to the diaphragm and the diaphragm may divide the internal space into two chambers, one of each side of the diaphragm, when supported on the ledge.

By supporting the first diaphragm on the ledge defined by the at least one indentation, a support structure extending into the internal space may be avoided, thus leaving more room in the internal space, e.g. for a larger motor. Alternatively, the housing may be made smaller without compromising the output.

The diaphragm may comprise at least one protrusion which may have a size and shape matching the at least one indentation to facilitate positioning and support of the diaphragm.

The diaphragm may be adhesively attached in indentation. In an alternative embodiment, the diaphragm may be fixed in the indentation by frictional forces, or otherwise fixed.

In one embodiment, the at least one indentation may define two ledges at opposite sides of the inner surface, so that the diaphragm may be supported at opposite ends, such as at opposite ends relative to the longest length of the diaphragm. This way of supporting the diaphragm may further facilitate positioning of the diaphragm when assembling the receiver-in-canal assembly.

In one embodiment, the total length of the at least one indentation constitute in the range of 20-60 percent of the total length of the circumference in the first plane about the diaphragm. It should be understood, that the total length of the at least one indentation is the sum of the length of each of the indentations, whereas the total length of the circumference in the first plane is the size of the circumference of the diaphragm along the edge hereof.

At least a part of the at least one indentation may be formed as a through hole 31*a*, 31*b* from the internal space to the external space. As the diaphragm may not fill-out the whole through hole, the remaining gap may be sealed by an adhesive fixing the diaphragm in the indentation 19.

The housing may comprise an upper and a lower part which when assembled forms the internal space inside the housing. In one embodiment, the at least one indentation may be formed as a recess in at least one wall section forming the lower part. In this embodiment the diaphragm may be arranged in the internal space by inserting it from above prior to assembling the housing.

The receiver-in-canal assembly may comprise a print board. In one embodiment, the print board may also be arranged such that at least a part of it can be projected onto the first diaphragm in a direction perpendicular to the first plane, or even onto the movable part hereof; i.e. under the diaphragm. The print board may additionally be arranged in the compartment formed by the protrusion of the internal shell.

The housing may comprise at least one venting opening to allow venting of the internal space. It should be understood, that at least one venting opening may additionally/alternatively be arranged in the internal shelf to allow venting hereof.

The at least one venting opening may be substantially circular with a diameter in the range of 0.02-0.20 mm, such as 0.05-0.15 mm. It should be understood, that the at least one venting opening may also be of another shape, such as elliptical, or any other regular or irregular shape. Openings of this size compared to larger openings may have the advantage that frequency peaks do not change and that the low frequency SPL (sound pressure level) increases.

The cable connection means may further comprise a connector system for indirect connection of the cable. A connector system comprising e.g. a plug and socket part may facilitate connection of the cable to the receiver-in-canal assembly and may further facilitate replacement of the cable as it may be detachably attached to the receiver-in-canal assembly.

The receiver-in-canal assembly may further comprise a second diaphragm extending in a second plane in the housing. To ensure that the housing is not expanded too much when including a second diaphragm, the cable connection means may be located between the first and second diaphragms in a direction perpendicular to the first plane. The first and second diaphragms extending in first and second planes may be arranged so that they extend substantially parallel to each other.

The first motor may be operatively connected to both the first diaphragm and to the second diaphragm.

In an alternative embodiment, the receiver-in-canal assembly may further comprise a second motor electrically connected to the cable connection means and operatively connected to the second diaphragm.

In different embodiments, the cable connection means may be located at different positions relative to the first diaphragm, such as at different distances to the first diaphragm in a direction perpendicular to the first plane.

In one embodiment, it may be an advantage if cable connection means is located in an area being located in the circumference of the centre at the wall of the housing where the opening for the cable is located, as a more centrally located opening may facilitate connection of the cable at the cable connection means.

Alternatively the cable connection means may be arranged with a larger distance to the first diaphragm. In one embodiment, a distance in the direction perpendicular to the first plane between the cable connection means and the first diaphragm exceeds 10 percent of the dimension of the cable connection means in the direction perpendicular to the first plane. By providing this larger distance more space is created for movement of the first diaphragm, whereby a large output may be achieved for a diaphragm of a specific length.

In one embodiment, neither the first motor, nor the cable connection means extends beyond the first diaphragm when projected onto the diaphragm in a direction perpendicular to the first plane. This may be achieved by providing a first motor and a cable connection means of a size and shape so that the total length of the first motor and the cable connection means in a plane parallel to the first plane is less than the length of the first diaphragm.

The space below the first diaphragm may additionally comprise other elements of the receiver-in-canal assembly, such as a receiver identification resistor, and/or other acoustic elements, e.g. a microphone, a telecoil, etc. In embodiments comprising a first and a second diaphragm, these additional elements may be arranged in a space between the two diaphragms. It should be understood, that at least some of these additional elements may be located in the compartment below the protrusion formed by the internal shell.

The volume of the cable connection means may by less than 10 percent of the volume of the first motor.

According to a second aspect, the invention provides a personal audio device comprising a receiver-in-canal assembly and a cable;

the receiver-in-canal assembly being for positioning in or at an ear canal of a user, and comprising;

- a housing comprising an opening between an exterior space outside the housing and an internal space inside the housing;
- a cable connection means located in the housing;
- a first diaphragm extending in a first plane in the housing, and
- a first motor electrically connected to the cable connection means and operatively connected to the first diaphragm, wherein the cable extends through the opening and is connected to the cable connection means in the housing, and wherein the cable connection means is located relative to the first diaphragm such that at least a part of it can be projected onto a movable part of the first diaphragm in a direction perpendicular to the first plane and located in continuation of the first motor in a plane parallel to the first plane.

It should be understood, that a skilled person would readily recognise that any feature described in combination with the first aspect of the invention could also be combined with the second aspect of the invention, and vice versa.

The receiver-in-canal assembly according to the first aspect of the invention is very suitable for the personal audio device according to the second aspect of the invention. The remarks set forth above in relation to the receiver-in-canal assembly are therefore equally applicable in relation to the personal audio device.

The personal audio device may in one embodiment be a hearing aid. However, the personal audio device may also comprise hearables, such as consumer accessories, etc.

The cable may terminate in a blunt in the housing, whereby the blunt may prevent the cable from being pulled out the housing.

Alternatively or additionally, the cable may be adhesively connected to the housing.

In a further alternative embodiment, the cable may be detachably attached to the receiver-in-canal assembly, e.g. by providing a cable connection means which comprises a connector system for indirect connection of the cable.

According to a third embodiment, the invention provides a receiver-in-canal assembly for positioning in or at an ear canal of a user, the receiver-in-canal assembly comprising;

- a housing comprising an opening between an exterior space outside the housing and an internal space inside the housing;
- a cable connection means located in the housing and facilitating connection of a cable to the receiver-in-canal assembly;
- a first diaphragm extending in a first plane in the housing, and
- a first motor electrically connected to the cable connection means and operatively connected to the first diaphragm, wherein the housing comprises an inner surface forming at least one indentation defining a ledge on which the first diaphragm is supported.

It should be understood, that a skilled person would readily recognise that any feature described in combination with the first and second aspects of the invention could also be combined with the third aspect of the invention, and vice versa.

According to a fourth embodiment, the invention provides a receiver-in-canal assembly for positioning in or at an ear canal of a user, the receiver-in-canal assembly comprising;

- a housing comprising an opening between an exterior space outside the housing and an internal space inside the housing;
- a cable connection means located in the housing and facilitating connection of a cable to the receiver-in-canal assembly;
- a first diaphragm extending in a first plane in the housing, and a first motor electrically connected to the cable connection means and operatively connected to the first diaphragm, wherein the first motor and the diaphragm are located in an internal shell in the housing, the internal shell forming a protrusion to create a compartment under the protrusion in the housing, and wherein the cable connection means is located relative to the protrusion such that at least a part of it can be projected onto the protrusion in a direction perpendicular to the first plane.

It should be understood, that a skilled person would readily recognise that any feature described in combination with the first, second, and third aspects of the invention could also be combined with the fourth aspect of the invention, and vice versa.

BRIEF DESCRIPTION OF THE DRAWINGS

Embodiments of the invention will now be further described with reference to the drawings, in which.

DETAILED DESCRIPTION OF PREFERRED EMBODIMENTS

It should be understood that the detailed description and specific examples, while indicating embodiments of the invention, are given by way of illustration only, since various changes and modifications within the spirit and scope of the invention will become apparent to those skilled in the art from this detailed description.

Figure 1A:
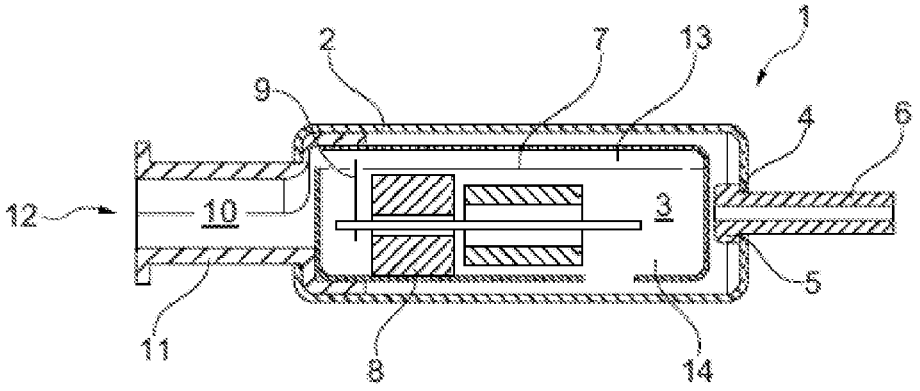
FIGS. 1A and 1B illustrate prior art receiver-in-canal assemblies.

FIG. 1A illustrates a prior art receiver-in-canal assembly 1 configured to be positioned in or at an ear canal of a user (not shown). The receiver-in-canal assembly 1 comprises a housing 2 having an inner space 3 and an opening 4 between an exterior space outside the housing 2 and the inner space 3.

Furthermore, the receiver-in-canal assembly 1 comprises a cable connection means 5 located in the housing 3 and facilitating connection of a cable 6 to the receiver-in-canal assembly 1, and a first diaphragm 7 which extends in a first plane in the housing 3. The receiver-in-canal assembly 1 additionally comprises a motor 8 which is electrically connected to the cable connection means and operatively connected to the first diaphragm 7. The electric connection between the motor 8 and the cable connection means 5 is not illustrated.

The motor 8 is operationally connected to the diaphragm by means of a drive pin 9.

The housing 2 comprises an elongated sound channel 10 provided in a spout member 11 terminating in a sound output 12 through which the receiver-in-canal assembly 1 can output sound. The sound channel 10 is arranged at the opposite end of the housing 2 relative to the opening 4 through which the cable 6 extends.

The diaphragm 7 divides the housing 3 into a first chamber 13 and a second chamber 14.

Figure 1B:
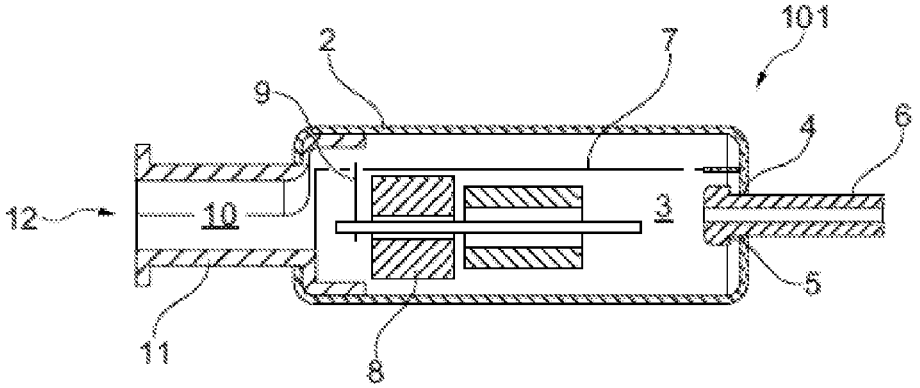

FIG. 1B illustrates a similar prior art receiver-in-canal assembly 101 configured to be positioned in or at an ear canal of a user (not shown). The receiver-in-canal assembly 1 comprises a housing 2 having an inner space 3 and an opening 4 between an exterior space outside the housing 2 and the inner space 3.

In the receiver-in-canal assembly 101 the separation of the housing 3 into a first and a second chamber (not shown) is done at the edges of the diaphragm 7 whereby the functionality of the housing 3 and the housing 2 can be combined.

Figure 2:
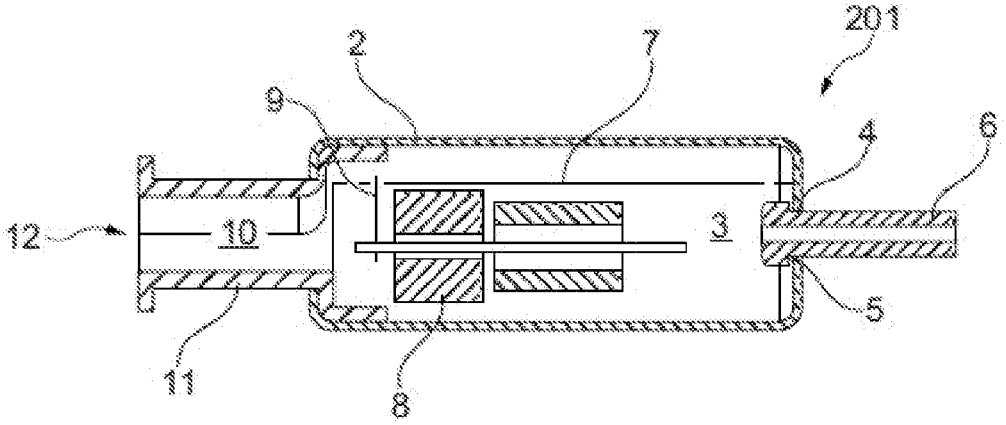
FIGS. 2, 3, and 4 illustrate different embodiments of receiver-in-canal assemblies according to the invention.

FIG. 2 illustrates a receiver-in-canal assembly 201 according to the invention. The receiver-in-canal assembly is configured to be positioned in or at an ear canal of a user (not shown). The receiver-in-canal assembly 201 comprises a housing 2 having an inner space 3 and an opening 4 between an exterior space outside the housing 2 and the inner space 3.

Furthermore, the receiver-in-canal assembly 201 comprises a cable connection means 5 located in the housing 3 and facilitating connection of a cable 6 to the receiver-in-canal assembly 201, and a first diaphragm 7 which extends in a first plane in the housing 3. The receiver-in-canal assembly 201 additionally comprises a first motor 8 which is electrically connected to the cable connection means and operatively connected to the first diaphragm 7. The electric connection between the first motor 8 and the cable connection means 5 is not illustrated.

To provide a shorter receiver-in-canal assembly 201 and/or a receiver-in-canal assembly 201 capable of providing more output compared to a receiver-in-canal assembly 1/101 of the same length, the cable connection means 5 is located at least partly under the first diaphragm 7 so that the first diaphragm 7 and the cable connection means 5 overlap in a direction perpendicular to the first diaphragm 7. I.e. the cable connection means 5 is located relative to the first diaphragm 7 such that at least a part of it can be projected onto a movable part of the first diaphragm 7 in a direction perpendicular to the first plane.

The motor 8 is operationally connected to the diaphragm by means of a drive pin 9.

The housing 2 comprises an elongated sound channel 10 provided in a spout member 11 terminating in a sound output 12 through which the receiver-in-canal assembly 201 can output sound. The sound channel 10 is arranged at the opposite end of the housing 2 relative to the opening 4 through which the cable 6 extends.

Figure 3:
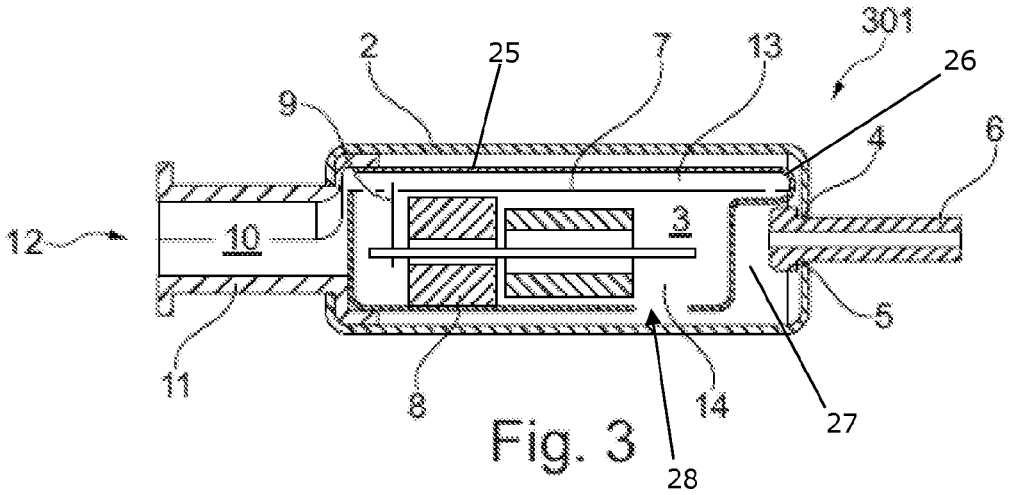
Figure 4:
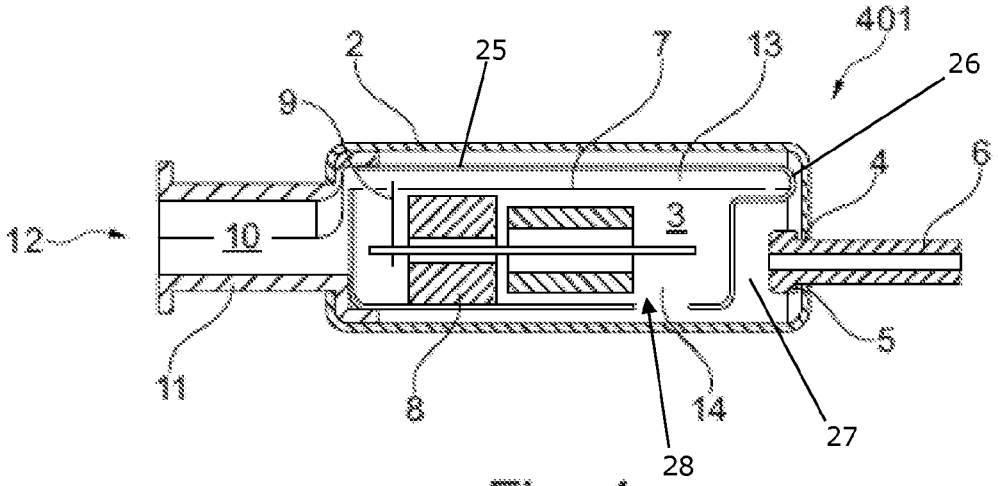

FIGS. 3 and 4 illustrate respectively a receiver-in-canal assembly 301, 401 according to the invention. The receiver-in-canal assemblies 301, 401 are configured to be positioned in or at an ear canal of a user (not shown). The receiver-in-canal assemblies 301, 401 each comprise a housing 2 having an inner space 3 and an opening 4 between an exterior space outside the housing 2 and the inner space 3.

Furthermore, the receiver-in-canal assemblies 301, 401 comprise a cable connection means 5 located in the housing 3 and facilitating connection of a cable 6 to the receiver-in-canal assembly 301, 401, and a first diaphragm 7 which extends in a first plane in the housing 3. The receiver-in-canal assembly 301, 401 additionally comprises a first motor 8 which is electrically connected to the cable connection means 5 and operatively connected to the first diaphragm 7.

The electric connection between the first motor 8 and the cable connection means 5 is not illustrated.

To provide a shorter receiver-in-canal assembly 301, 401 and/or a receiver-in-canal assembly 301, 401 capable of providing more output compared to a receiver-in-canal assembly 1/101 of the same length, the cable connection means 5 is located at least partly under the first diaphragm 7 so that the first diaphragm 7 and the cable connection means 5 overlap in a direction perpendicular to the first diaphragm 7. I.e. the cable connection means 5 is located relative to the first diaphragm 7 such that at least a part of it can be projected onto a movable part of the first diaphragm 7 in a direction perpendicular to the first plane.

The motor 8 is operationally connected to the diaphragm 7 by means of a drive pin 9. The diaphragm 7 divides the housing 3 into a first chamber 13 and a second chamber 14.

The housing 2 comprises an elongated sound channel 10 provided in a spout member 11 terminating in a sound output 12 through which the receiver-in-canal assembly 301, 401 can output sound. The sound channel 10 is arranged at the opposite end of the housing 2 relative to the opening 4 through which the cable 6 extends.

In FIG. 3, the cable connection means 5 is located substantially in the centre of the wall having the opening for the cable 6, i.e. in an area being located in the circumference of the centre at the wall of the housing 2 where the opening 4 for the cable 6 is located.

In FIG. 4, the cable connection means 5 is arranged with a larger distance to the first diaphragm 7, i.e. closer to the bottom part of the housing. By providing this larger distance, more space is created for movement of the first diaphragm 7, whereby a large output can be achieved for a diaphragm of a specific length.

In FIGS. 3 and 4, the motor 8 and the diaphragm 7 are located in an internal shell 25 in the housing. The internal shell 25 forms a protrusion 26 thereby creating a compartment 27 under the protrusion in the housing 2. The cable connection means 5 are located relative to the protrusion 26 such that at least a part of it can be projected onto the protrusion 28 in a direction perpendicular to the first plane.

Furthermore, the internal shell 25 comprises a venting opening 28 to allow venting of the space defined inside the internal shell 25.

Figure 5:
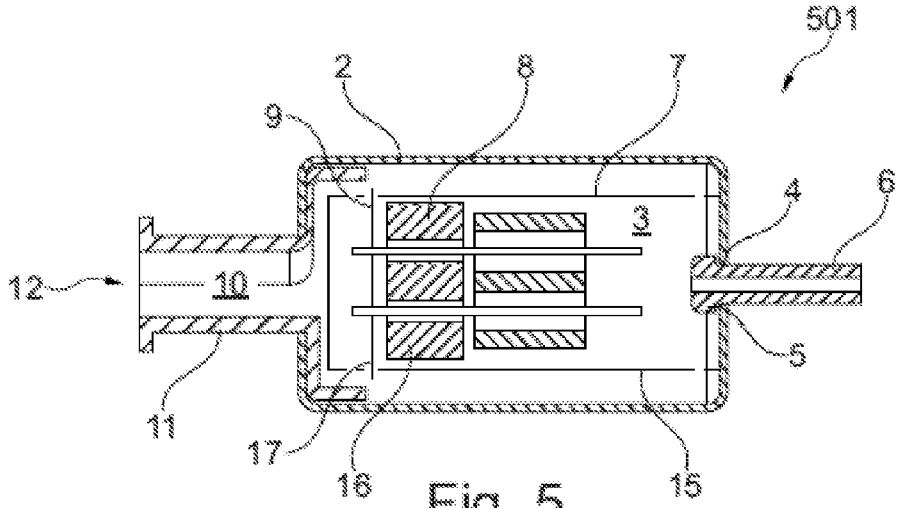
FIG. 5 illustrates a further embodiment of a receiver-in-canal assembly according to the invention, where the receiver-in-canal assembly comprises two motors.

FIG. 5 illustrates a receiver-in-canal assembly 501 according to the invention. The receiver-in-canal assembly is configured to be positioned in or at an ear canal of a user (not shown). The receiver-in-canal assembly 501 comprises a housing 2 having an inner space 3 and an opening 4 between an exterior space outside the housing 2 and the inner space 3.

Furthermore, the receiver-in-canal assembly 501 comprises a cable connection means 5 located in the housing 3 and facilitating connection of a cable 6 to the receiver-in-canal assembly 501, and a first diaphragm 7 which extends in a first plane in the housing 3. The receiver-in-canal assembly 501 additionally comprises a first motor 8 which is electrically connected to the cable connection means 5 and operatively connected to the first diaphragm 7. The electric connection between the first motor 8 and the cable connection means 5 is not illustrated.

The receiver-in-canal assembly 501 additionally comprises a second diaphragm 15 which extends in a second plane in the housing 3, and a second motor 16 which is electrically connected to the cable connection means 5 and operatively connected to the second diaphragm 15. The electric connection between the second motor 16 and the cable connection means 5 is not illustrated.

To provide a shorter receiver-in-canal assembly 501 and/or a receiver-in-canal assembly 501 capable of providing more output compared to a receiver-in-canal assembly 1/101 of the same length, the cable connection means 5 is located at least partly between the first diaphragm 7 and the second diaphragm 15 so that the first diaphragm 7 and the cable connection means 5 overlap in a direction perpendicular to the first diaphragm 7, and so that the second diaphragm 15 and the cable connection means 5 overlap in a direction perpendicular to the first direction. I.e. the cable connection means 5 is located relative to the first diaphragm 7 and the second diaphragm 15 such that at least a part of it can be projected onto a movable part of the first diaphragm 7 and onto the second diaphragm 15 in a direction perpendicular to the first plane. The first and second diaphragms 7, 15 extend substantially parallel to each other.

The first motor 8 is operationally connected to the first diaphragm by means of a drive pin 9. Whereas the second motor 16 is operationally connected to the second diaphragm 15 by means of a second drive pin 17.

The housing 2 comprises an elongated common sound channel 10 provided in a spout member 11 terminating in a sound output 12 through which the receiver-in-canal assembly 501 can output sound. The sound channel 10 is arranged at the opposite end of the housing 2 relative to the opening 4 through which the cable 6 extends.

Figure 6:
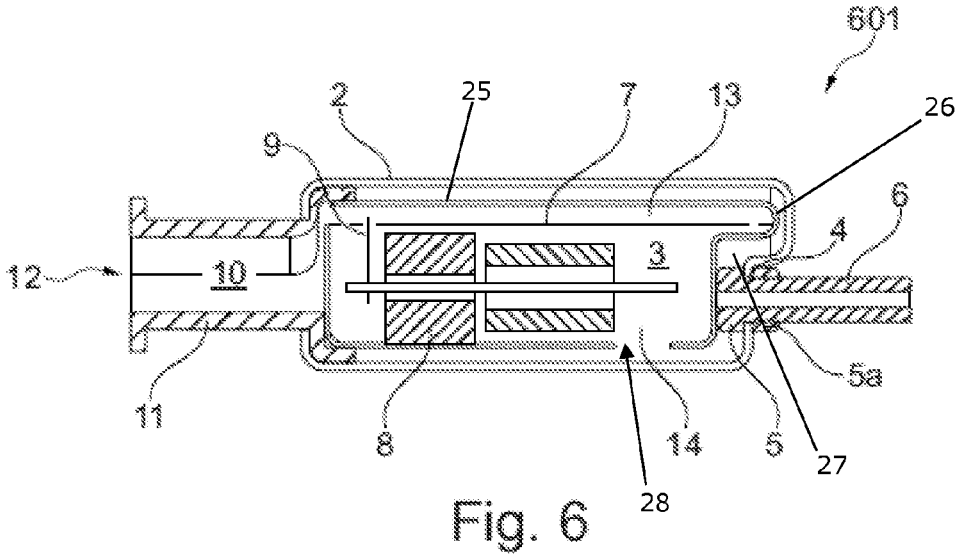
FIG. 6 illustrates an even further embodiment of a receiver-in-canal assembly according to the invention.

FIG. 6 illustrates a receiver-in-canal assembly 601 being similar to the assembly 401 of FIG. 4. The receiver-in-canal assembly 601 comprises a housing 2 having an inner space 3 and an opening 4 between an exterior space outside the housing 2 and the inner space 3.

Furthermore, the receiver-in-canal assembly 601 comprises a cable connection means 5 facilitating connection of a cable 6 to the receiver-in-canal assembly 601, a first diaphragm 7 which extends in a first plane in the housing 3, and a first motor 8 which is electrically connected to the cable connection means 5 and operatively connected to the first diaphragm 7. The electric connection between the first motor 8 and the cable connection means 5 is not illustrated.

The cable connection means 5 is located at least partly under the first diaphragm 7 so that the first diaphragm 7 and the cable connection means 5 overlap in a direction perpendicular to the first diaphragm 7. I.e. the cable connection means 5 is located relative to the first diaphragm 7 such that at least a part of it can be projected onto a movable part of the first diaphragm 7 in a direction perpendicular to the first plane. A part of the cable connection means **5*a* is located outside the housing 2. By providing a part of the cable connection means 5 in the housing and a part of the cable connection 5*a* outside the housing, the cable connection means 5, 5*a* locks the cable to the housing 2 and ensure that the cable 6 cannot be pulled out of the housing 2 nor can it be pushed into the inner space 3** of the housing.

The motor 8 is operationally connected to the diaphragm 7 by means of a drive pin 9. The diaphragm 7 divides the housing 3 into a first chamber 13 and a second chamber 14.

The housing 2 comprises an elongated sound channel 10 provided in a spout member 11 terminating in a sound output 12 through which the receiver-in-canal assembly 601 can output sound. The sound channel 10 is arranged at the opposite end of the housing 2 relative to the opening 4 through which the cable 6 extends.

In FIG. 6, the motor 8 and the diaphragm 7 are located in an internal shell 25 in the housing. The internal shell 25 forms a protrusion 26 thereby creating a compartment 27 under the protrusion in the housing 2. The cable connection means 5 are located relative to the protrusion 26 such that at least a part of it can be projected onto the protrusion 28 in a direction perpendicular to the first plane.

Furthermore, the internal shell 25 comprises a venting opening 28 to allow venting of the space defined inside the internal shell 25.

Figure 7:
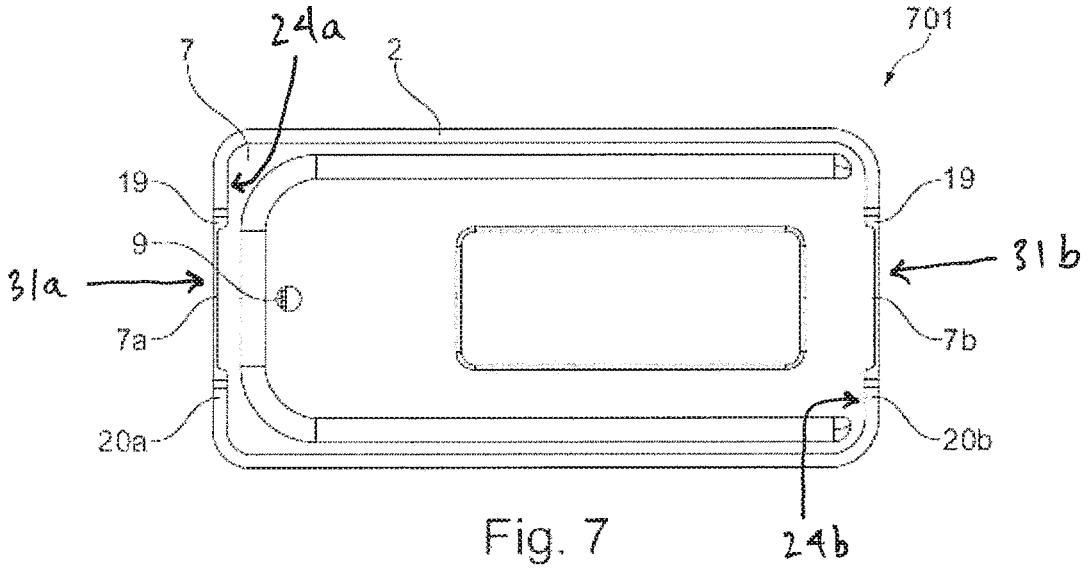
FIGS. 7 and 8 illustrate an embodiment of a receiver-in-canal assembly according to the invention.
Figure 8:
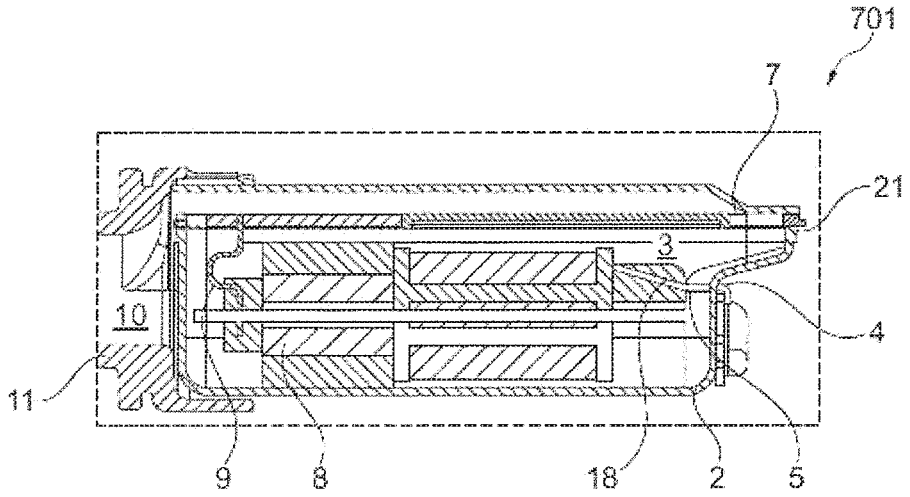

FIGS. 7 and 8 illustrate cross-sections through a receiver-in-canal assembly 701, where the cross-section in FIG. 7 is along the first plane, and the cross-section in FIG. 8 is perpendicular to the first plane. The receiver-in-canal assembly 701 is configured to be positioned in or at an ear canal of a user (not shown). The receiver-in-canal assembly 701 comprises a housing 2 having an inner space 3 and an opening 4 between an exterior space outside the housing 2 and the inner space 3.

Furthermore, the receiver-in-canal assembly 701 comprises a cable connection means 5 located in the housing 3 and facilitating connection of a cable (not shown) to the receiver-in-canal assembly 701, and a first diaphragm 7 which extends in a first plane in the housing 3. The receiver-in-canal assembly 701 additionally comprises a first motor 8 which is electrically connected to the cable connection means and operatively connected to the first diaphragm 7. The electric connection between the first motor 8 and the cable connection means 5 is illustrated by the wire 18.

The cable connection means 5 is located at least partly under the first diaphragm 7 so that the first diaphragm 7 and the cable connection means 5 overlap in a direction perpendicular to the first diaphragm 7. I.e. the cable connection means 5 is located relative to the first diaphragm 7 such that at least a part of it can be projected onto a movable part of the first diaphragm 7 in a direction perpendicular to the first plane.

The motor 8 is operationally connected to the diaphragm by means of a drive pin 9.

The housing 2 comprises an elongated sound channel 10 provided in a spout member 11 terminating in a sound output (not shown) through which the receiver-in-canal assembly 701 can output sound. The sound channel 10 is arranged at the opposite end of the housing 2 relative to the opening 4 through which the cable extends.

The diaphragm 7 comprises as each end a protrusion 7*a*, 7*b* having a size and shape matching an indentation 19 formed in opposite wall sections 20*a*, 20*b* of the housing 2 to facilitate positioning and support of the diaphragm 7 in the internal space 3. The diaphragm 7 is kept in place by use of an adhesive 21.

Figure 9:
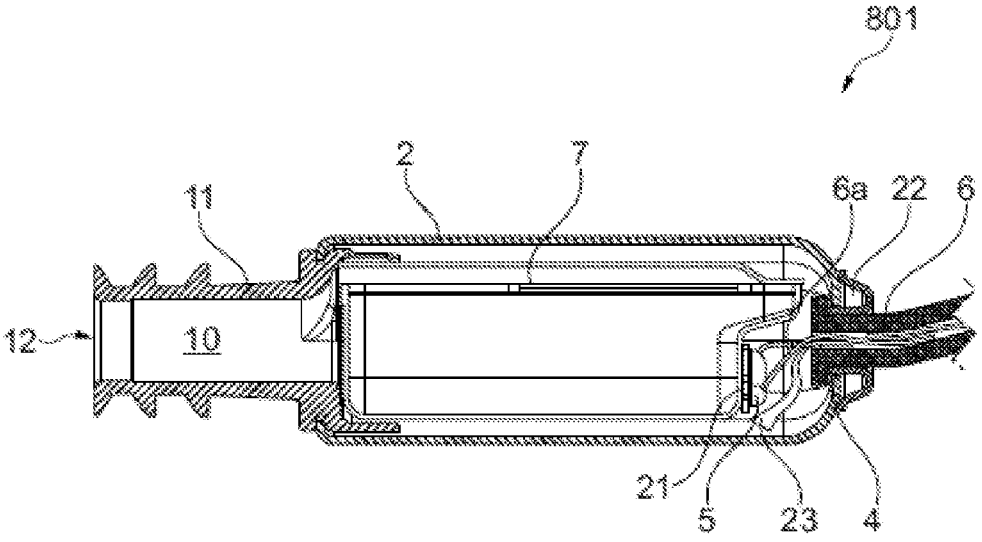
FIG. 9 illustrates another embodiment of a receiver-in-canal assembly according to the invention.

FIG. 9 illustrates a receiver-in-canal assembly 801 where the print board 21 is located under the diaphragm 7 so that the diaphragm and the print board overlap in a direction perpendicular to the first diaphragm 7. The receiver-in-canal assembly 801 comprises a housing 2 having an inner space 3 and an opening 4 between an exterior space outside the housing 2 and the inner space 3.

Furthermore, the receiver-in-canal assembly 701 comprises a cable connection means 5 located in the housing 3 and facilitating connection of a cable 6 to the receiver-in-canal assembly 801. The cable 6 comprises a litz wire 6*a* for connection to the cable connection means. The receiver-in-canal assembly 801 additionally comprises a first diaphragm 7 which extends in a first plane in the housing 3 and a first motor (not shown) which is electrically connected to the cable connection means and operatively connected to the first diaphragm 7. The motor 8 is operationally connected to the diaphragm by means of a drive pin 9.

The cable connection means 5 is located at least partly under the first diaphragm 7 so that the first diaphragm 7 and the cable connection means 5 overlap in a direction perpendicular to the first diaphragm 7. I.e. the cable connection means 5 is located relative to the first diaphragm 7 such that at least a part of it can be projected onto a movable part of the first diaphragm 7 in a direction perpendicular to the first plane.

The housing 2 comprises an elongated sound channel 10 provided in a spout member 11 terminating in a sound output (not shown) through which the receiver-in-canal assembly 801 can output sound. The sound channel 10 is arranged at the opposite end of the housing 2 relative to the opening 4 through which the cable 6 extends.

The cable 6 is fixed to the housing 2 by use of a grommet 22 arranged on the outside of the housing and by the blunt 23 which terminates the isolation of the cable 6 inside the housing.

Figure 10A:
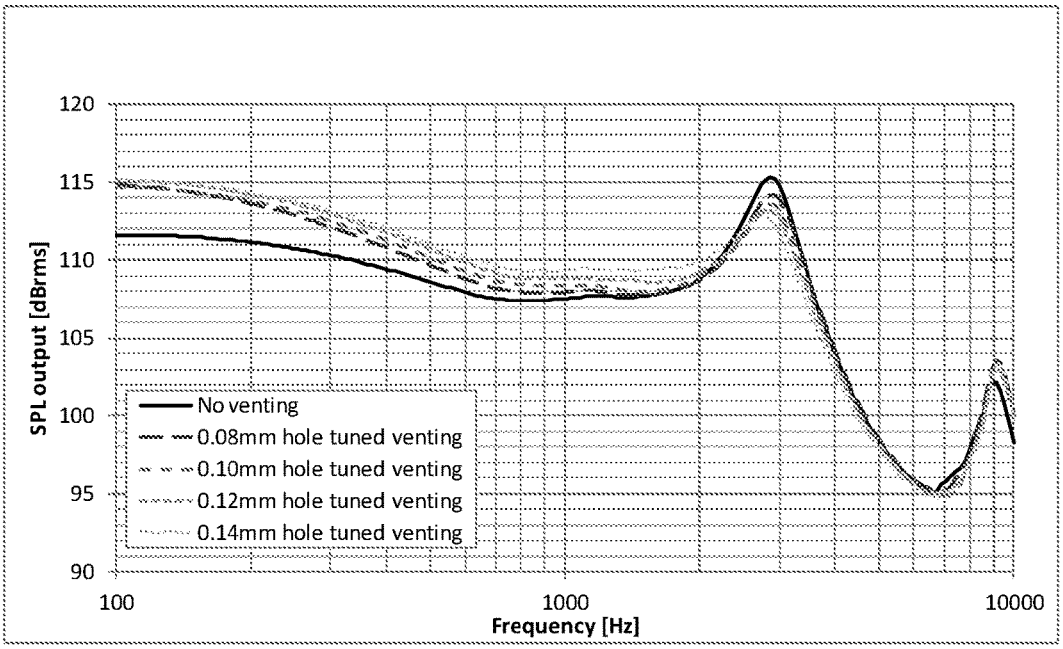
FIGS. 10*a* and 10*b* illustrate output in relation to venting openings.

FIG. 10*a* illustrates the SPL Output in relation frequency response measured with constant nominal voltage drive for receiver-in-canal assemblies comprising a venting opening of different size compared to a receiver-in-canal assembly without a venting opening.

Figure 10B:
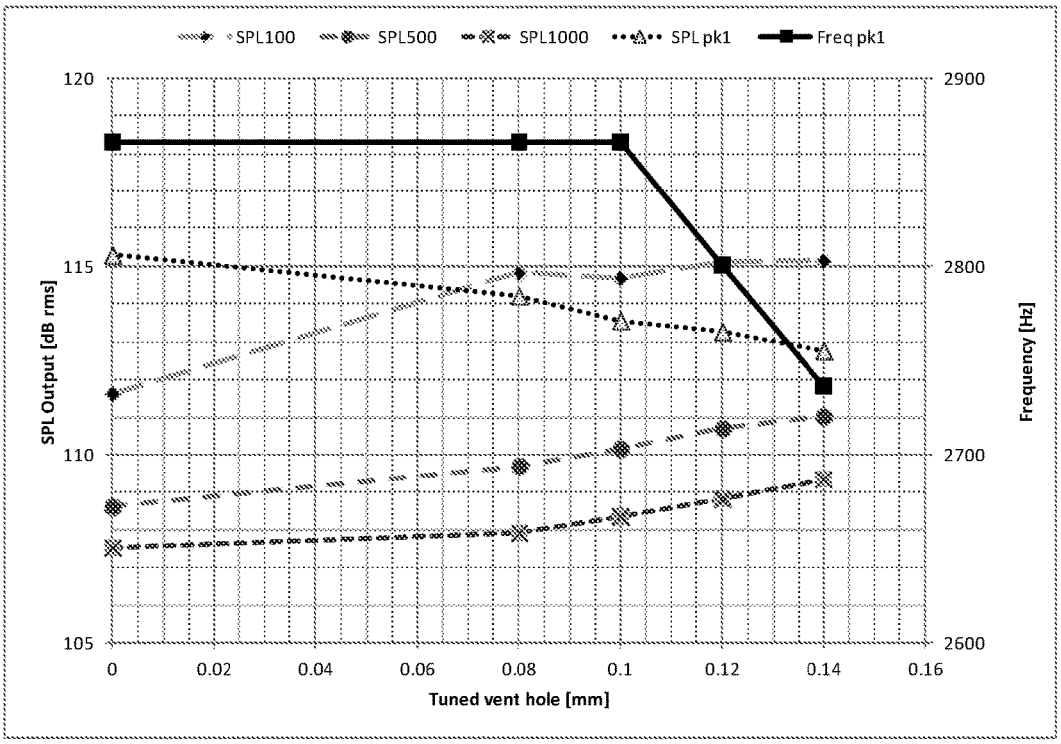

FIG. 10*b* illustrates the SPL Output and frequency in relation the size of a venting opening.

The invention claimed is:

1. A receiver-in-canal assembly for positioning in or at an ear canal of a user, the receiver-in-canal assembly comprising;

a housing comprising an opening between an exterior space outside the housing and an internal space inside the housing;

a cable connection means located in the housing and facilitating connection of a cable to the receiver-in-canal assembly;

a first diaphragm extending in a first plane in the housing, and a first motor electrically connected to the cable connection means and operatively connected to the first diaphragm, wherein the cable connection means is located relative to the first diaphragm such that at least a part of it can be projected onto a movable part of the first diaphragm in a direction perpendicular to the first plane and located in continuation of the first motor in a plane parallel to the first plane.

2. A receiver-in-canal assembly according to claim 1, wherein the first motor is located relative to the first diaphragm such that at least a part of the first motor can be projected onto the first diaphragm in a direction perpendicular to the first plane.

3. A receiver-in-canal assembly according to claim 2, wherein the projection of the cable connection means onto the movable part of the first diaphragm does not overlap the projection of the least a part of the first motor onto the first diaphragm.

4. A receiver-in-canal assembly according to claim 1, wherein the housing comprises an inner surface forming at least one indentation defining a ledge on which the first diaphragm is supported.

5. A receiver-in-canal assembly according to claim 4, wherein the at least one indentation defines two ledges at opposite sides of the inner surface.

6. A receiver-in-canal assembly according to claim 5, wherein the total length of the at least one indentation constitutes in the range of 20-60 percent of the total length of the circumference in the first plane about the diaphragm.

7. A receiver-in-canal assembly according to claim 6, wherein at least a part of the at least one indentation is formed at a through hole from the internal space to the external space.

8. A receiver-in-canal assembly according to claim 5, wherein at least a part of the at least one indentation is formed at a through hole from the internal space to the external space.

9. A receiver-in-canal assembly according to claim 4, wherein the total length of the at least one indentation constitute in the range of 20-60 percent of the total length of the circumference in the first plane about the diaphragm.

10. A receiver-in-canal assembly according to claim 9, wherein at least a part of the at least one indentation is formed at a through hole from the internal space to the external space.

11. A receiver-in-canal assembly according to claim 4, wherein at least a part of the at least one indentation is formed at a through hole from the internal space to the external space.

12. A receiver-in-canal assembly according to claim 1, wherein the cable connection means comprises a connector system for indirect connection of the cable.

13. A receiver-in-canal assembly according to claim 1, further comprising a second diaphragm extending in a second plane in the housing, wherein the cable connection means is located between the first and second diaphragms in a direction perpendicular to the first plane.

14. A receiver-in-canal assembly according to claim 13, further comprising a second motor electrically connected to the cable connection means and operatively connected to the second diaphragm.

15. A receiver-in-canal assembly according to claim 1, wherein a total length of the first motor and the cable connection means in a plane parallel to the first plane is less than the length of the first diaphragm.

16. A receiver-in-canal assembly according to claim 1, wherein the first motor and the diaphragm are located in an internal shell in the housing.

17. A receiver-in-canal assembly according to claim 16, wherein the internal shell forms a protrusion to create a compartment under the protrusion in the housing, and wherein the cable connection may be located relative to the protrusion such that at least a part of it can be projected onto the protrusion in a direction perpendicular to the first plane.

18. A receiver-in-canal assembly according to claim 17, wherein the shell comprises at least one venting opening.

19. A receiver-in-canal assembly according to claim 16, wherein the shell comprises at least one venting opening.

20. A personal audio device comprising a receiver-in-canal assembly and a cable;

the receiver-in-canal assembly being for positioning in or at an ear canal of a user, and comprising;

a housing comprising an opening between an exterior space outside the housing and an internal space inside the housing;

a cable connection means located in the housing;

a first diaphragm extending in a first plane in the housing, and a first motor electrically connected to the cable connection means and operatively connected to the first diaphragm, wherein the cable extends through the opening and is connected to the cable connection means in the housing, and wherein the cable connection means is located relative to the first diaphragm such that at least a part of it can be projected onto a movable part of the first diaphragm in a direction perpendicular to the first plane and located in continuation of the first motor in a plane parallel to the first plane.

* * * * *